US008951069B2

(12) United States Patent
Kan et al.

(10) Patent No.: US 8,951,069 B2
(45) Date of Patent: Feb. 10, 2015

(54) ELECTRICAL CONNECTOR

(71) Applicant: Kinsun Industries Inc., Pingjhen City (TW)

(72) Inventors: Ching-Neng Kan, Taoyuan County (TW); Li-Chin Yang, Taoyuan County (TW)

(73) Assignee: Kinsun Industries Inc., Pingjhen (TW)

( * ) Notice: Subject to any disclaimer, the term of this patent is extended or adjusted under 35 U.S.C. 154(b) by 2 days.

(21) Appl. No.: 14/047,568

(22) Filed: Oct. 7, 2013

(65) Prior Publication Data

US 2014/0256189 A1 Sep. 11, 2014

(30) Foreign Application Priority Data

Mar. 8, 2013 (TW) ..... 102204333 U

(51) Int. Cl.

| | |
|---|---|
| ***H01R 25/00*** | (2006.01) |
| ***H01R 12/71*** | (2011.01) |
| ***H01R 13/41*** | (2006.01) |
| ***H01R 13/516*** | (2006.01) |
| *H01R 12/70* | (2011.01) |
| *H01R 24/64* | (2011.01) |

(52) U.S. Cl.

CPC ..... *H01R 12/716* (2013.01); *H01R 13/41* (2013.01); *H01R 13/516* (2013.01); *H01R 12/7023* (2013.01); *H01R 24/64* (2013.01)

USPC ..... 439/638

(58) Field of Classification Search

CPC ..... H01R 23/7005; H01R 13/518

USPC ..... 439/328, 326, 637, 540.1, 64, 92, 159, 439/492

See application file for complete search history.

(56) References Cited

U.S. PATENT DOCUMENTS

| | | | | |
|---|---|---|---|---|
| 6,162,990 | A * | 12/2000 | Sakamoto | 174/59 |
| 6,641,443 | B1 * | 11/2003 | Itano et al. | 439/676 |
| 7,025,635 | B2 * | 4/2006 | Chang | 439/620.07 |
| 8,758,047 | B2 * | 6/2014 | Dietz et al. | 439/540.1 |
| 2014/0256189 | A1 * | 9/2014 | Kan et al. | 439/660 |

* cited by examiner

*Primary Examiner* — Phuongchi T Nguyen
(74) *Attorney, Agent, or Firm* — WPAT, PC; Justin King

(57) ABSTRACT

An electrical connector comprises: a frame, a terminal set, and a base. The frame further comprises: a first receiving part, for receiving a first unit while allowing the first unit to be installed in a first direction; a second receiving part; a supporting part, for supporting and installing a circuitboard in the first direction; and a plurality of sockets, arranged in communication with the first receiving part; and a through penetration part, formed at a position between the first receiving part and the second receiving part. The terminal set includes a plurality of terminals, each formed with a first end and a second end, and each first end is inserted into its corresponding socket and protruding outside the supporting part, and each second end is disposed protruding into the first receiving part. The base is formed with a plurality of grooves for receiving the plural terminals in a one-by-one manner.

9 Claims, 4 Drawing Sheets

ELECTRICAL CONNECTOR

FIELD OF THE INVENTION

The present invention relates to an electrical connector, and more particularly, to an electrical connector that is designed for allowing a circuitboard to be arranged in a direction different from those conventional settlement-plate-type electrical connectors, so that the connection strength between the electrical connector and the circuitboard is enhanced while the support to the circuitboard is strengthened.

BACKGROUND OF THE INVENTION

For achieving thinner, lighter and smaller, most designer and manufacturers of electronic devices adopts settlement-plate-type electrical connectors, which are featured by that it is designed to be received inside a hole/gaps formed on a circuitboard while allowing the conductive terminals, which can be arranged at a side or at the bottom of the electrical connector, to be inset into and weld to corresponding sockets of the circuitboard for enabling an electric connection to be achieved between the electrical connector and the circuitboard, and thereby, the overall thickness or height of the electrical connection structure can be reduced.

As the electrical connection and fixing between the conventional electrical connectors and corresponding circuitboards is achieved only by the welding of the conductive terminals of the electrical connector to the circuitboard, which is disadvantageous not only in that the circuit board is not sufficiently supported, but also because of the electrical connector can easily being driven to wobble while plugging or unplugging, the electrical connection between the electrical connector and the circuitboard can fail consequently, or even the electrical connector can be detached from the circuitboard while unplugging.

SUMMARY OF THE INVENTION

In view of the disadvantages of prior art, the primary object of the present invention is to provide an electrical connector that is designed for allowing a circuitboard to be arranged in a direction different from those conventional settlement-plate-type electrical connectors, so that the connection strength between the electrical connector and the circuitboard is enhanced while the support to the circuitboard is strengthened.

To achieve the above object, the present invention provides an electrical connector, comprising:

a frame, having a first receiving part, a second receiving part, a supporting part and a plurality of sockets being arranged therein in a manner that the first receiving part is provided for receiving a first unit while allowing the first unit to be installed in a first direction, the supporting part is provided for supporting a circuitboard while allowing the circuitboard to be installed thereat in the first direction; and the plural sockets are arranged in communication with the first receiving part while there is a through penetration part formed at a position between the first receiving part and the second receiving part for allowing the first and the second receiving parts to be in communication with each other thereby;

a terminal set, including a plurality of terminals, and each terminal being formed with a first end and a second end that are arranged opposite to one another, while allowing each first end to be inserted into its corresponding socket while being enabled to protrude outside the supporting part, and each second end to be disposed protruding into the first receiving part; and a base, being formed with a plurality of grooves to be used for receiving the plural terminals therein in a one-buy-one manner, while allowing the base to be installed inside the second receiving part in a second direction that is opposite to the first direction.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

As the embodiment shown in FIG. 1 to FIG. 4, the electrical connector comprises: a frame 10, a terminal set 20 and a base 30, in which the frame 10 and the base 30 are respectively made of an insulating material.

Figure 4:
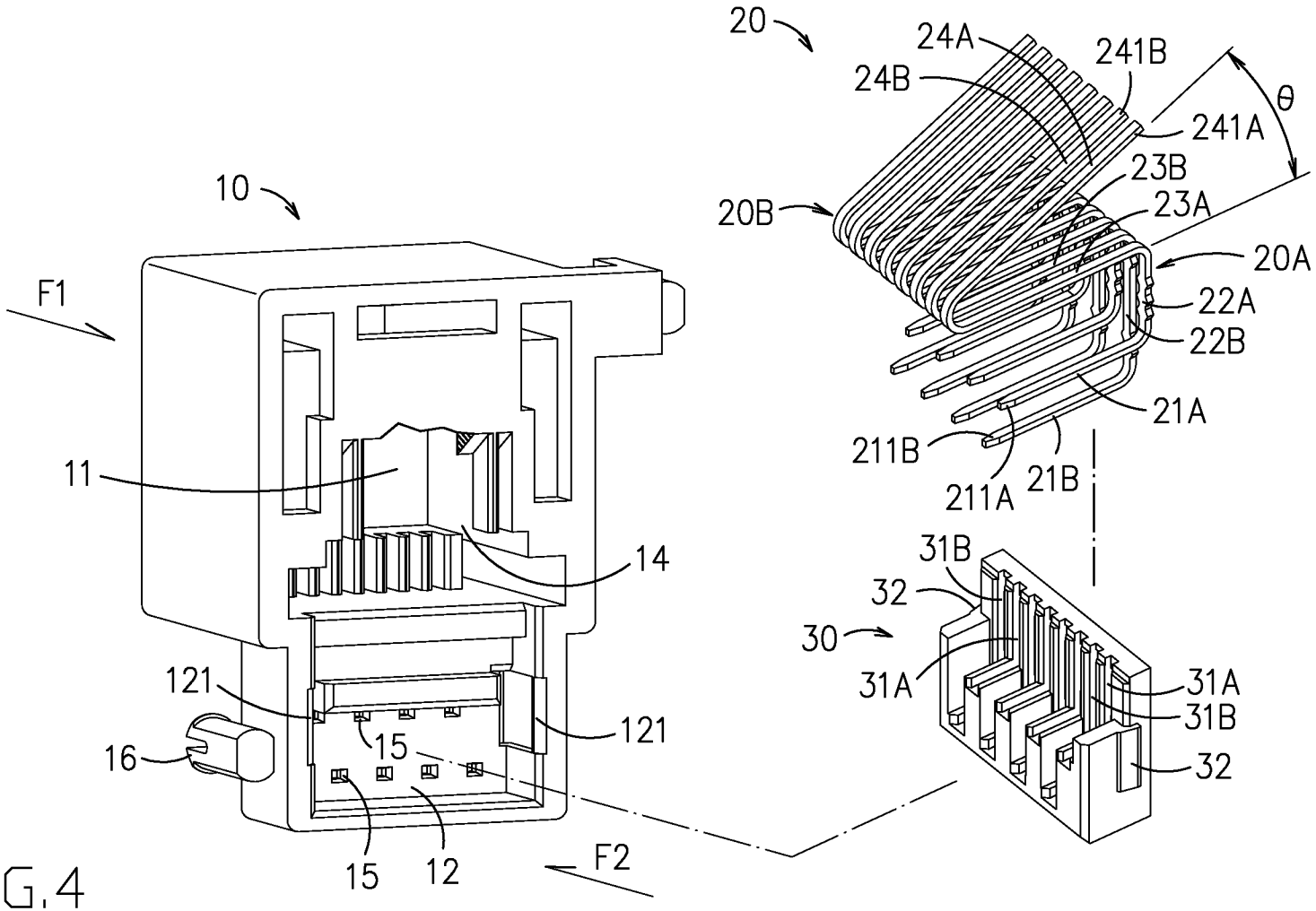
FIG. 4 is an exploded view of the electrical connector of FIG. 1 as it is being viewed in another angle.
Figure 5:
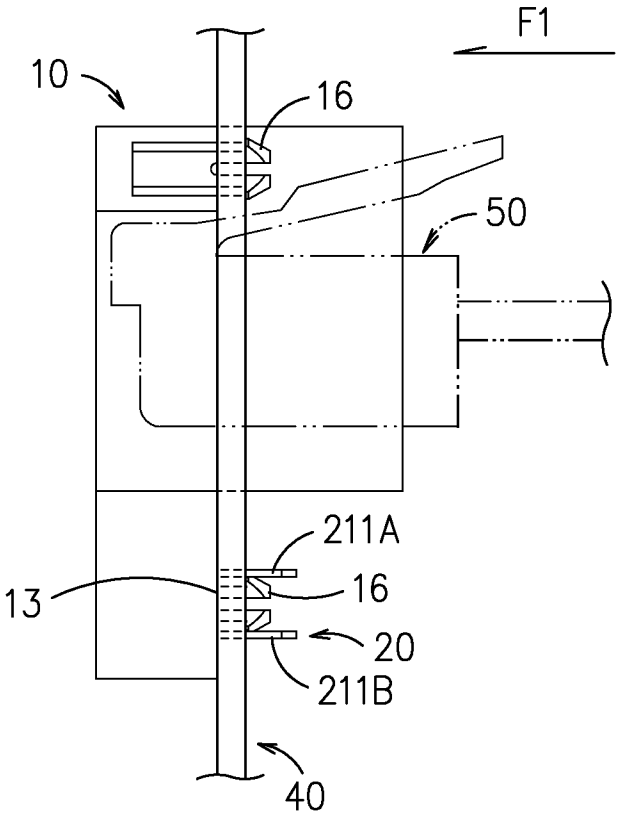
FIG. 5 is a side view of a circuitboard to be installed in the electrical connector of FIG. 1.

In this embodiment, the frame 10 has a first receiving part 11, a second receiving part 12, and a supporting part 13, in which the first receiving part 11 is provided for receiving a first unit, the supporting part 13 is provided for supporting a circuitboard 40, as shown in FIG. 5, and the second receiving part 12 is provided for receiving the base 30. In addition, the first unit can be installed in a first direction F1 into the first receiving part 11, and thus can be plugged out of the first receiving part 11 in a direction opposite to the first direction F1. Consequently, the first receiving part is designed in different shapes according to actual requirements for allowing the same to receiving various types of first units. For instance, the first receiving part 11 can be designed to receive an RJ-45 plug or an RJ-11 plug 50 shown in FIG. 5, so that the first unit can be an RJ-45 plug or an RJ-11 plug 50. Moreover, there is a through penetration part 14 formed at a position between the first receiving part 11 and the second receiving part 13, as shown in FIG. 4, by that the first receiving part 11 is enabled to communicate with the second receiving part 13. In addition, the frame 10 further being formed with a plurality of sockets 15, which are designed to be in communication with the first receiving part 11, and also there are at least one elastic hook 16 being arranged at two opposite sides of the frame 10.

The terminal set 20 includes a plurality of first terminals 20A and a plurality of second terminals 20B, whereas each of the first and the second terminals 20A and 20B is made of a conductive material. Taking a first terminal 20A for example, each first terminal 20A is formed with a first engaging part 21A, a mounting part 22A, a connecting part 23A and a second engaging part 24A, and each of the first engaging part 21A, the mounting part 22A, the connecting part 23A and the second engaging part 24A is formed with a length in respective. In an embodiment, the first engaging part 21A is arranged extending in a direction parallel to the first direction F1, the mounting part 22A is arranged extending in a direction perpendicular to the first direction F1 while having protrusions 221A being formed respectively at two opposite length sides of the mounting part 22A, the connecting part 23A is arranged extending in a direction parallel to the first direction F1, and the second engaging part 24A is arranged extending in a direction for enabling an small-than-90° included angle θ to be formed between the extending of the second engaging part 24A and the extending of the connecting part 23A. Moreover, the first engaging part 21A, the mounting part 22A, the connecting part 23A and the second engaging part 24A are serially connected with each other in length direction. An end of the first engaging part 21A that is opposite to the end thereof connected to the mounting part 22A is being referred as a first end 211A, while an end of the second engaging part 24A that is opposite to the end thereof connected to the connecting part 23A is being referred as a second end 241A.

Figure 2:
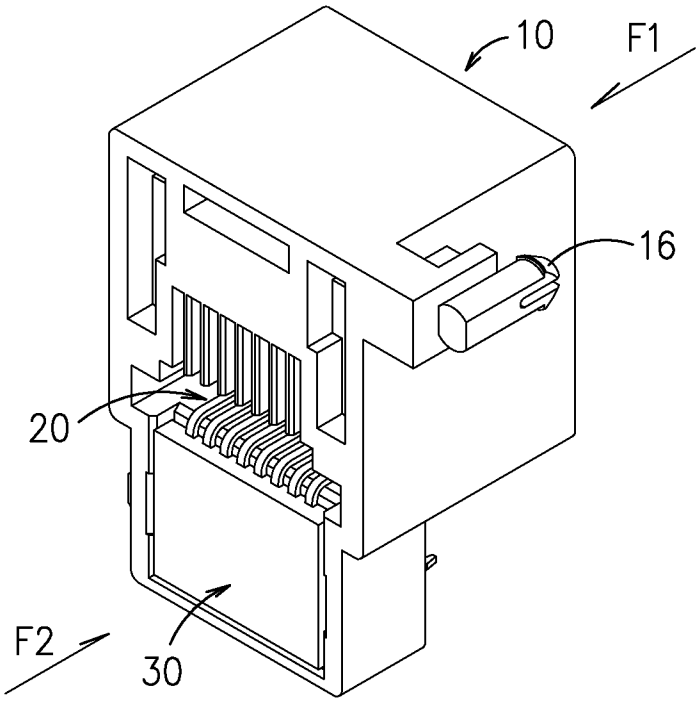
FIG. 2 is a schematic diagram of the electrical connector of FIG. 1 as it is being viewed in another angle.
Figure 1:
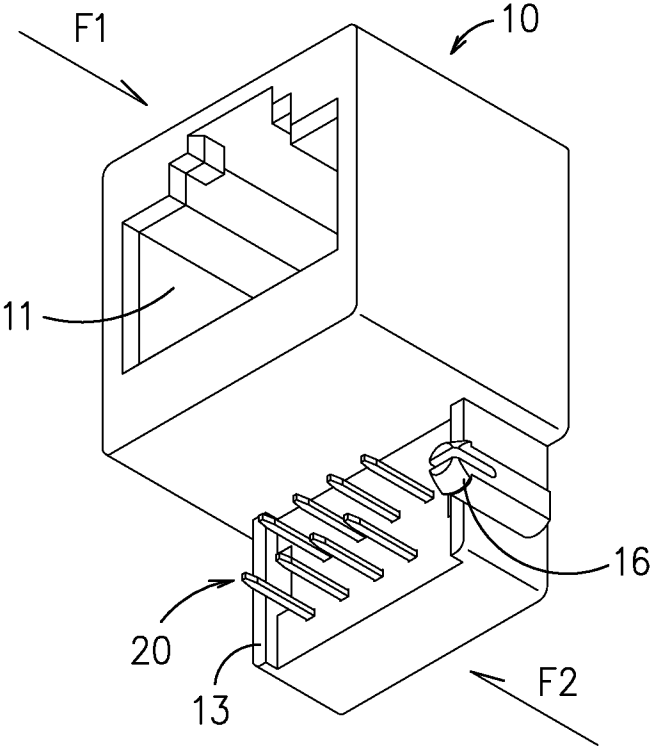
FIG. 1 is a three-dimensional view of an electrical connector according to an embodiment, of the present invention.
Figure 3A:
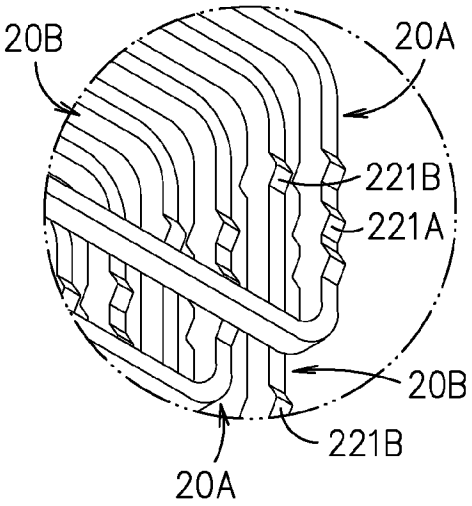
FIG. 3A is an enlarged diagram showing the structure enclosed in the 3A portion of FIG. 3.
Figure 3:
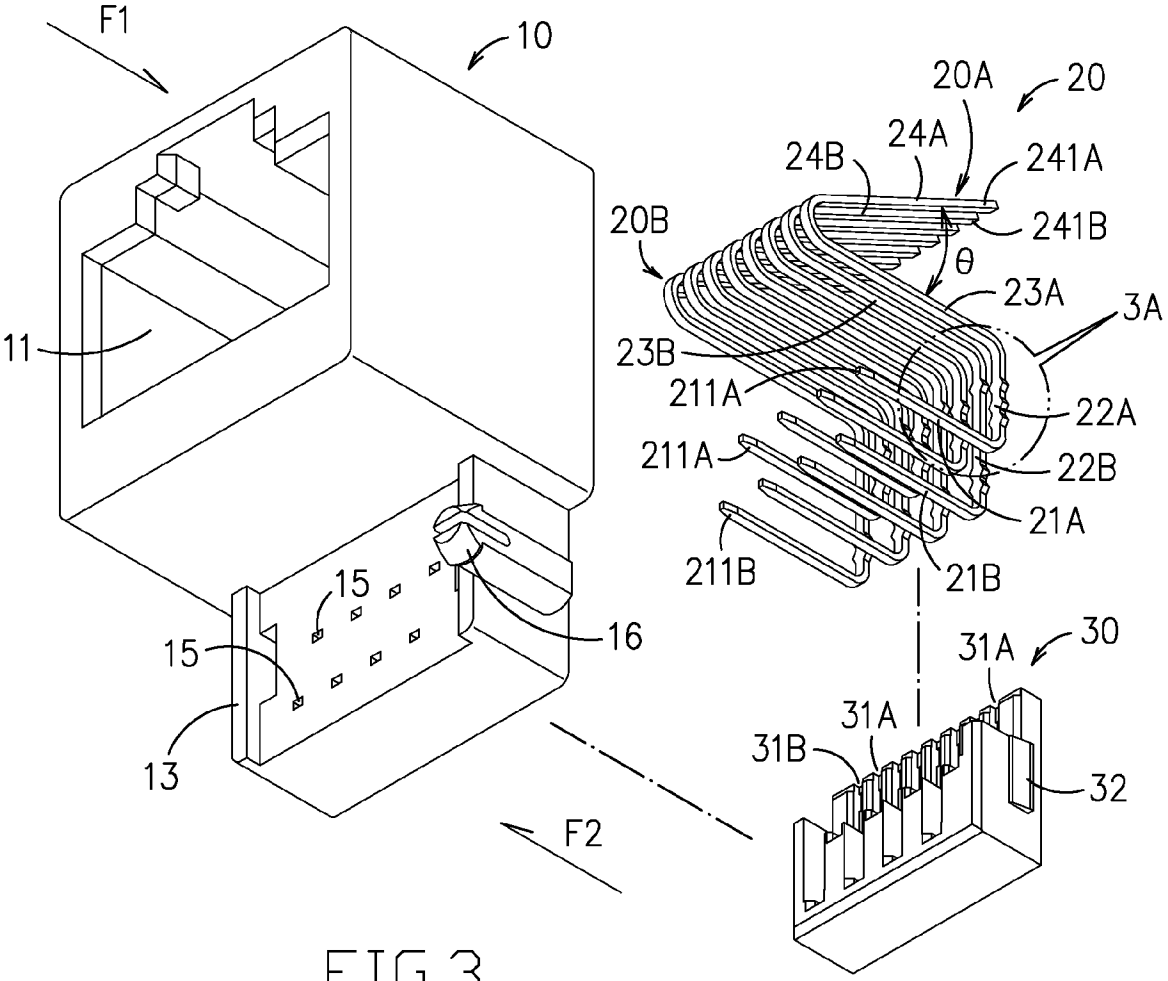
FIG. 3 is an exploded view of the electrical connector of FIG. 1.

The second terminal 20B is structurally the same as the first terminal 20A. Thus, each second terminal 20B is formed with a first engaging part 21B, a mounting part 22B, a connecting part 23B and a second engaging part 24B. Similarly, an end of the first engaging part 21B that is opposite to the end thereof connected to the mounting part 22B is being referred as a first end 211B, while an end of the second engaging part 24B that is opposite to the end thereof connected to the connecting part 23B is being referred as a second end 241B. The mounting part 22B also has protrusions 221B being formed respectively at two opposite length sides of the mounting part 22B. The difference between the first terminal 22A and second terminal 22B is that: there mounting parts 22A, 22B are formed in different lengths. In an embodiment, the length of the mounting part 22A of the first terminal 20A is shorter than that of the second terminal 22B. In addition, as the first terminals and the second terminals are arranged in an alternating manner, so that the first ends 211A and 211B are interleaving with each other, as shown in FIG. 3.

The base 30 is formed with a plurality of grooves 31A and 31B at positions respectively corresponding to the first terminals 20A and the second terminals 20B, so that the first terminals 20A and the second terminals 20B can be inset into the plural grooves 31A and 31B in a one-buy-one manner, whereas the protrusions 221A and 221B are arranged tightly engaging and wedged to the inner walls of the grooves 31A, 31B, so that the terminal set 20 can be assembled with the base 30.

In the present invention, there can be a locking structure arranged between the second receiving part 12 and the base 30 to be used for locking the two together. In an embodiment, the second receiving part 12 has two first hooks 121 being arranged respectively at two opposite inner walls of the second receiving part 12, while the base 30 has two second hooks 32 being arranged respectively at two opposite outer walls of the base 30, and the first hooks 121 are designed to lock onto their corresponding second hooks 32 when the base 30 assembled with the terminal set 20 is being installed into the second receiving part 12 in a second direction F2 that is opposite to the first direction F1. The first ends 211A and 211N are respectively inserted into their corresponding sockets 15 while being enabled to protrude outside the supporting part 13, and the second ends 241A and 241B are respectively disposed protruding into the first receiving part 11.

Figure 6:
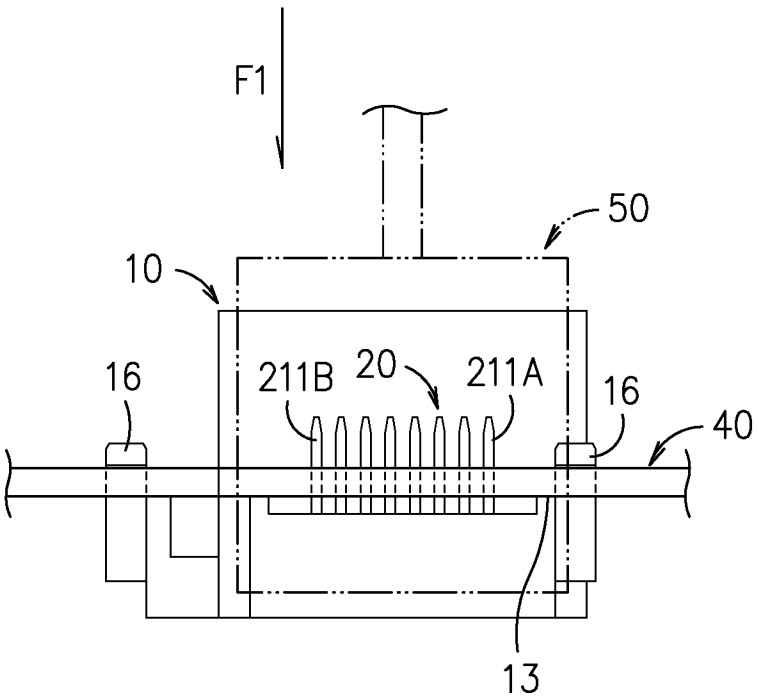
FIG. 6 is a bottom view of a circuitboard to be installed in the electrical connector of FIG. 1.

As shown in FIG. 5 and FIG. 6, the circuit board 40 is formed with holes at positions corresponding to the first ends 211A and 211B and the elastic hooks 16, and thereby, when the circuitboard 40 is being installed to the supporting part 13 in the first direction F1, the first ends 211A and 211B are arranged protruding outside a surface of the circuitboard 40 that is arranged opposite to the supporting part 13. That is, the elastic hooks 16 and the protruding first ends 211A and 211B are arranged respectively inserting into their corresponding holes while allowing the same to protrude outside a surface of the circuitboard 40 that is arranged opposite to the supporting part 13. Thereby, the circuitboard 40 can be assembled to the frame 10. Thus, when a plug 50 is inserted into the connector in a first direction F1, the circuitboard 40 can be supported by the supporting part 13 and the elastic hooks 16. On the other hand, when the plug 50 is being pulled out in a direction opposite to the first direction F1, the frame is enabled to abut against the circuitboard 40 via the supporting part 13 so as to prevent the frame 10 and the terminal set 20 from wobbling during the unplugging.

To sum up, the present invention provides an electrical connector that is designed for allowing a circuitboard to be arranged in a direction different from those conventional settlement-plate-type electrical connectors, so that the connection strength between the electrical connector and the circuitboard is enhanced while the support to the circuitboard is strengthened.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. An electrical connector, comprises:

a frame, having a first receiving part, a second receiving part, a supporting part and a plurality of sockets being arranged therein in a manner that the first receiving part is provided for receiving a first unit while allowing the first unit to be installed in a first direction, the supporting part is provided for supporting a circuit board while allowing the circuit board to be installed thereat in the first direction; and the plural sockets are arranged in communication with the first receiving part while there is a through penetration part formed at a position between the first receiving part and the second receiving part for allowing the first and the second receiving parts to be in communication with each other thereby;

a terminal set, including a plurality of terminals, and each terminal being formed with a first end and a second end that are arranged opposite to one another, while allowing each first end to be inserted into its corresponding socket while being enabled to protrude outside the supporting part, and each second end to be disposed protruding into the first receiving part; and a base, being formed with a plurality of grooves to be used for receiving the plural terminals therein in a one-buy-one manner, while allowing the base to be installed inside the second receiving part in a second direction that is opposite to the first direction;

wherein each terminal is formed with a first engaging part, a mounting part, a connecting part and a second engaging part, and each of the first engaging part, the mounting part, the connecting part and the second engaging part is formed with a length in respective, while allowing the first engaging part, the mounting part, the connecting part and the second engaging part to be serially connected with each other in length direction;

wherein the first engaging part is arranged extending in a direction parallel to the first direction, the mounting part is arranged extending in a direction perpendicular to the first direction, the connecting part is arranged extending in a direction parallel to the first direction, and the second engaging part is arranged extending in a direction for enabling an small-than-90° included angle to be formed between the extending of the second engaging part and the extending of the connecting part;

wherein the second receiving part has two first hooks being arranged respectively at two opposite inner walls of the second receiving part, while the base has two second hooks being arranged respectively at two opposite outer walls of the base, and the first hooks are designed to lock onto the second hooks.

2. The electrical connector of claim 1, wherein the two opposite sides of the mounting part that are extending along its length direction are formed respectively with protrusions, and the extrusions are arranged to inset and wedged tightly into the grooves.

3. The electrical connector of claim 1, wherein the plural terminals includes a plurality of first terminals and a plurality of second terminals that are alternatively arranged, and the mounting part of the first terminal is formed with a length different from that of the mounting part of the second terminal.

4. The electrical connector of claim 1, wherein there is a locking structure arranged between the second receiving part and the base to be used for locking the two together.

5. The electrical connector of claim 1, wherein there is at least one elastic hook being arranged respectively at two opposites sides of the frame, while the circuitboard is formed with holes at positions corresponding to the elastic hooks so as to allowing the elastic hooks to inset therein and lock onto the a surface of the circuitboard that is arranged opposite to the supporting part.

6. The electrical connector of claim 1, wherein the circuit board is formed with holes at positions corresponding to the first ends that are arranged protruding outside the supporting part, and thereby, the protruding first ends are arranged inserting into their corresponding holes for allowing the same to protrude outside a surface of the circuitboard that is arranged opposite to the supporting part.

7. The electrical connector of claim 1, wherein the frame and the base are each being made of insulating material.

8. The electrical connector of claim 1, wherein each terminal is made of conductive material.

9. The electrical connector of claim 1, wherein the first unit is a plug.

* * * * *